US008449288B2

(12) United States Patent
Higgins

(10) Patent No.: US 8,449,288 B2
(45) Date of Patent: May 28, 2013

(54) UREA-BASED MIXING PROCESS FOR INCREASING COMBUSTION EFFICIENCY AND REDUCTION OF NITROGEN OXIDES (NOX)

(75) Inventor: Brian S. Higgins, Raleigh, NC (US)

(73) Assignee: Nalco Mobotec, Inc., Naperville, IL (US)

( * ) Notice: Subject to any disclaimer, the term of this patent is extended or adjusted under 35 U.S.C. 154(b) by 0 days.

(21) Appl. No.: 11/455,924

(22) Filed: Jun. 19, 2006

(65) Prior Publication Data

US 2007/0003890 A1 Jan. 4, 2007

Related U.S. Application Data

(63) Continuation of application No. 10/798,093, filed on Mar. 11, 2004, now abandoned, which is a continuation-in-part of application No. 10/391,825, filed on Mar. 19, 2003, now abandoned, and a continuation-in-part of application No. 10/461,567, filed on Jun. 13, 2003, now abandoned, and a continuation-in-part of application No. 10/742,260, filed on Dec. 20, 2003.

(51) Int. Cl.
*F23D 11/44* (2006.01)

(52) U.S. Cl.
USPC ..... 431/11; 431/181; 431/187; 431/115; 431/177; 431/354; 239/397.5; 239/132.2; 239/424; 423/210; 423/235; 423/244.05; 110/190; 110/215

(58) Field of Classification Search
USPC ..... 431/4, 11, 9, 8, 116, 350, 351, 352, 431/207, 215, 181, 187, 115, 177, 354, 5, 431/75; 110/264, 265, 213, 214, 190, 215, 110/345; 239/397.5, 132.3, 424, 145; 60/226.2, 60/230; 423/210, 235, 244.05, 244.01; 432/235
See application file for complete search history.

(56) References Cited

U.S. PATENT DOCUMENTS

| | | | | |
|---|---|---|---|---|
| 3,105,540 | A | 10/1963 | Hardgrove | 431/9 |
| 3,528,797 | A | 9/1970 | Funk et al. | 71/39 |
| 3,565,575 | A | 2/1971 | Warshaww et al. | 23/3 |
| 3,773,897 | A | 11/1973 | Fields et al. | 423/235 |

(Continued)

FOREIGN PATENT DOCUMENTS

| | | |
|---|---|---|
| DE | 28 37 156 A1 | 3/1979 |
| EP | 0 326 943 | 1/1989 |

(Continued)

OTHER PUBLICATIONS

Energy efficiency-our specialty; Mobotec.

(Continued)

*Primary Examiner* — Avinash Savani
(74) *Attorney, Agent, or Firm* — MacCord Mason PLLC

(57) ABSTRACT

A method for reducing NOx formation, including the steps of: providing a furnace with a plurality of secondary air injection ducts, asymmetrically positioned in an opposing manner; injecting fuel with primary air through a first stage prior to injection of a second air; injecting secondary air and aqueous urea solution through the plurality of reagent injection ducts; controlling the asymmetrical injection to produce a high velocity mass flow and a turbulence resulting in dispersion of the urea solution into the combustion space, thereby providing reduced NOx formation in the combustion process.

32 Claims, 9 Drawing Sheets

U.S. PATENT DOCUMENTS

| | | | | |
|---|---|---|---|---|
| 3,847,564 | A | 11/1974 | Marion et al. | 48/95 |
| 3,860,384 | A | 1/1975 | Vulliet et al. | 431/4 |
| 3,900,554 | A | 8/1975 | Lyon | 423/235 |
| 3,970,739 | A | 7/1976 | Shiraishi et al. | 423/23 |
| 4,021,188 | A | 5/1977 | Yamagishi et al. | 431/158 |
| 4,029,752 | A | 6/1977 | Cahn | 423/563 |
| 4,039,446 | A | 8/1977 | Ban et al. | 210/688 |
| 4,080,423 | A | 3/1978 | Smith et al. | 423/210 |
| 4,089,639 | A | 5/1978 | Reed et al. | 431/211 |
| 4,119,702 | A | 10/1978 | Azuhata et al. | 423/235 |
| 4,150,631 | A | 4/1979 | Frey et al. | 110/186 |
| 4,154,581 | A | 5/1979 | Nack et al. | 48/197 |
| 4,173,454 | A | 11/1979 | Heins | 44/522 |
| 4,196,057 | A | 4/1980 | May et al. | 205/775.5 |
| 4,208,386 | A | 6/1980 | Arand et al. | 423/235 |
| 4,213,944 | A | 7/1980 | Azuhata et al. | 423/235 |
| 4,294,178 | A | 10/1981 | Borio et al. | 110/347 |
| 4,318,718 | A | 3/1982 | Utsumi et al. | 110/347 |
| 4,325,924 | A | 4/1982 | Arand et al. | 423/235 |
| 4,375,949 | A | 3/1983 | Salooja | 431/7 |
| 4,381,718 | A | 5/1983 | Carver et al. | 110/347 |
| 4,469,050 | A | 9/1984 | Korenberg | 122/4 |
| 4,502,633 | A | 3/1985 | Saxon | 239/422 |
| 4,504,211 | A | 3/1985 | Beardmore | 44/604 |
| 4,506,608 | A | 3/1985 | Strohmeyer, Jr. | 110/245 |
| 4,507,075 | A | 3/1985 | Buss et al. | 431/115 |
| 4,507,269 | A | 3/1985 | Dean et al. | 423/235 |
| 4,565,137 | A | 1/1986 | Wright | 110/264 |
| 4,584,948 | A | 4/1986 | Syred et al. | 110/264 |
| 4,624,840 | A | 11/1986 | Dean et al. | 423/235 |
| 4,627,965 | A | 12/1986 | Hegemann et al. | 423/242 |
| 4,672,900 | A | 6/1987 | Santalla et al. | 431/9 |
| 4,704,084 | A | 11/1987 | Liu et al. | 431/7 |
| 4,751,065 | A | 6/1988 | Bowers | 423/235 |
| 4,777,024 | A | 10/1988 | Epperly et al. | 423/235 |
| 4,780,289 | A | 10/1988 | Epperly et al. | 423/235 |
| 4,824,441 | A | 4/1989 | Kindig | 44/604 |
| 4,842,834 | A | 6/1989 | Burton | 423/235 |
| 4,873,930 | A | 10/1989 | Egense et al. | 110/345 |
| 4,915,036 | A | 4/1990 | DeVita | 110/215 |
| 4,927,612 | A | 5/1990 | Bowers | 423/235 |
| 4,962,711 | A | 10/1990 | Yamauchi et al. | 110/347 |
| 4,978,514 | A | 12/1990 | Hofmann et al. | 423/235 |
| 4,985,218 | A | 1/1991 | DeVita | 423/235 |
| 4,992,249 | A | 2/1991 | Bowers | 423/235 |
| 5,017,347 | A | 5/1991 | Epperly et al. | 423/235 |
| 5,032,154 | A | 7/1991 | Wright | 422/109 |
| 5,048,432 | A | 9/1991 | Hofmann et al. | 110/345 |
| 5,052,921 | A | 10/1991 | Hemsath | 423/121 |
| 5,057,293 | A | 10/1991 | Epperly et al. | 423/235 |
| 5,105,747 | A | 4/1992 | Khinkis et al. | 110/345 |
| 5,139,754 | A | 8/1992 | Luftglass et al. | 423/235 |
| 5,146,858 | A | 9/1992 | Tokuda et al. | 110/261 |
| 5,240,404 | A | 8/1993 | Hemsath et al. | 431/9 |
| 5,261,602 | A | 11/1993 | Brent et al. | 239/132.3 |
| 5,286,467 | A | 2/1994 | Sun | 423/239.1 |
| 5,310,334 | A | 5/1994 | Spiros | 431/5 |
| 5,336,081 | A | 8/1994 | Saito et al. | 431/190 |
| 5,342,592 | A | 8/1994 | Peter-Hoblyn et al. | 423/235 |
| 5,345,883 | A | 9/1994 | Panos | 110/345 |
| 5,489,419 | A | 2/1996 | Diep et al. | 423/235 |
| 5,536,482 | A | 7/1996 | Diep et al. | 423/235 |
| 5,585,081 | A | 12/1996 | Chu et al. | 423/239.1 |
| 5,690,039 | A | 11/1997 | Monroe et al. | 110/264 |
| 5,707,596 | A | 1/1998 | Lewandowski et al. | 423/235 |
| 5,728,357 | A | 3/1998 | von Harpe | 423/239.1 |
| 5,809,910 | A | 9/1998 | Svendssen | 110/235 |
| 5,853,684 | A | 12/1998 | Fang et al. | 423/244.1 |
| 5,854,173 | A | 12/1998 | Chang et al. | 502/417 |
| 6,019,068 | A | 2/2000 | Tsuo et al. | 122/4 |
| 6,042,371 | A | 3/2000 | Mitani et al. | 431/215 |
| 6,109,911 | A | 8/2000 | Tamminen et al. | 431/4 |
| 6,190,628 | B1 | 2/2001 | Carter | 422/168 |
| 6,213,032 | B1 | 4/2001 | Breen et al. | 110/345 |
| 6,230,664 | B1 | 5/2001 | Janka et al. | 122/4 |
| 6,280,695 | B1 | 8/2001 | Lissianski et al. | 423/239.1 |
| 6,315,551 | B1 | 11/2001 | Salzsieder et al. | 431/183 |
| 6,357,367 | B1 | 3/2002 | Breen et al. | 110/345 |
| 6,398,039 | B1 | 6/2002 | Xue et al. | 210/504 |
| 6,453,830 | B1 * | 9/2002 | Zauderer | 110/345 |
| 6,485,289 | B1 | 11/2002 | Kelly et al. | 431/4 |
| 6,527,828 | B2 | 3/2003 | Flippo et al. | 95/54 |
| 6,532,905 | B2 | 3/2003 | Belin et al. | 122/4 |
| 6,818,043 | B1 | 11/2004 | Chang et al. | 95/37 |
| 6,953,494 | B2 | 10/2005 | Nelson, Jr. | 95/134 |
| 7,198,769 | B2 | 4/2007 | Cichanowicz | 423/239.1 |
| 7,335,014 | B2 | 2/2008 | Higgins | 431/4 |
| 2003/0110948 | A1 | 6/2003 | Gaita et al. | 96/108 |
| 2004/0045437 | A1 | 3/2004 | Chang et al. | 95/134 |
| 2004/0120872 | A1 | 6/2004 | Fan et al. | 423/239.1 |
| 2004/0185399 | A1 | 9/2004 | Moberg | 431/4 |
| 2004/0185401 | A1 | 9/2004 | Moberg | 431/9 |
| 2004/0185402 | A1 | 9/2004 | Moberg | 431/9 |
| 2004/0253161 | A1 | 12/2004 | Higgins | 423/235 |
| 2005/0000901 | A1 | 1/2005 | Campbell et al. | 210/660 |
| 2005/0002841 | A1 | 1/2005 | Moberg | 423/235 |
| 2005/0013755 | A1 | 1/2005 | Higgins | 423/235 |

FOREIGN PATENT DOCUMENTS

| | | |
|---|---|---|
| EP | 287 224 | 10/1998 |
| EP | 0936 405 | 8/1999 |
| GP | 2 001 419 | 7/1978 |
| JP | 53-112273 | 9/1978 |
| JP | 2003-21322 A | 1/2003 |
| WO | WO87/03507 | 6/1987 |
| WO | WO2005/079305 | 2/2005 |

OTHER PUBLICATIONS

Cmbined DeNox/DeSox and additional NOx Reduction by Cleaning Flue Gas Condensate from Ammonia, Moberg, et al., PowerGen Intl. Nov. 30-Dec. 2, 1999.

RJM-LT, "Does This New NOx Control Technology Obeolete SCRs"; RMJ Corp.

* cited by examiner

Area A

Area A

Area B

Area C

Area A

Area A

UREA-BASED MIXING PROCESS FOR INCREASING COMBUSTION EFFICIENCY AND REDUCTION OF NITROGEN OXIDES (NOX)

CROSS-REFERENCE TO RELATED APPLICATIONS

This non-provisional utility patent application claims the benefit of one or more prior filed applications, with a reference to each such prior application as follows: the present application is a Continuation of U.S. Ser. No. 10/798,093 filed Mar. 11, 2004 now abandoned, which is a Continuation-In-Part of application Ser. Nos. 10/391,825 filed Mar. 19, 2003 now abandoned, 10/461,567 filed Jun. 13, 2003 now abandoned, and 10/742,260 filed Dec. 20, 2003, which are incorporated herein by reference in their entirety.

BACKGROUND OF THE INVENTION (1) Field of the Invention

The present invention relates generally to a system and method for improving the efficiency of combustion reactions and for reducing pollutants, and, more particularly, to a system and method for improving combustion efficiency and reduction of nitrogen oxides (NOx) using nitrogenous agents.

(2) Description of the Prior Art

Increases in fuel costs have required power generation plants seek increases in furnace efficiencies in order to reduce power generation costs. However, NOx formation must also be prevented to comply with environmental regulations. NOx formation is reduced in furnaces by the process of stage combustion, which includes administering an initial substoichiometric or suboptimal ratio of oxygen to fuel to maintain combustion gas temperatures below the peak NOx-producing temperature, about 2,800 degrees F. (approximately 1540 degrees C.), followed by the addition of secondary air, or over-fire-air (OFA), to finish the combustion reaction. Proper mixing of secondary air and combustion gases inside a furnace is thus important to achieve optimum combustion and has been improved by the use of rotating over-fire-air (ROFA). However, these existing NOx reduction systems do not optimize combustion efficiency or furnace heat exchange efficiency.

Therefore, a need exists to improve energy efficiency of ROFA systems without negatively affecting, or even improving the reduction of pollutants, in particular NOx reduction.

The use of urea and NH3-generating compounds is known in the prior art. Example of the use of urea and NH3-generating compounds include U.S. Pat. No. 4,992,249 issued Feb. 12, 1991 to Bowers for Reduction of nitrogen- and carbon-based pollutants through the use of urea solutions and U.S. Pat. No. 4,927,612 issued May 22, 1990 invented by Bowers for Reduction of nitrogen- and carbon-based pollutants teaches process using a dispersion of aqueous urea solution is injected into an effluent for reducing nitrogen oxides in an effluent from the combustion of carbonaceous fuel.

U.S. Pat. No. 5,057,293 issued May 22, 1990 invented by Epperly, et al. and assigned to Fuel Tech, Inc. for Multi-stage process for reducing the concentration of pollutants in an effluent teaches a process for the reduction of the concentration of nitrogen oxides in the effluent from the combustion of a carbonaceous fuel, the process comprising selecting a plurality of locations for introduction of chemical formulations and introducing at each of said locations at least one chemical formulation, selected from the group consisting of urea, ammonia, hexamethylenetetraamine, an oxygenated hydrocarbon, a paraffinic hydrocarbon, an olefinic hydrocarbon, an aromatic hydrocarbon, an ammonium salt of an organic acid having a carbon to nitrogen ratio of greater than 1:1, a hydroxy amino hydrocarbon, a heterocyclic hydrocarbon having at least one cyclic oxygen, a five- or six-membered heterocyclic hydrocarbon having at least one cyclic nitrogen, hydrogen peroxide, guanidine, guanidine carbonate, biguanidine, guanylurea sulfate, melamine, dicyandiamide, calcium cyanamide, biuret, 1,1'-azobisformamide, methylol urea, methylol urea-urea condensation product, dimethylol urea, methyl urea, methyl urea, and mixtures thereof, effective to reduce the concentration of nitrogen oxides at the effluent temperature existing at said location, such that optimization of the level of injection at each of said locations leads to the reduction of the level of nitrogen oxides below a predetermined target level.

U.S. Pat. No. 4,208,386 issued Jun. 17, 1980 to Arand, et al. for Urea reduction of NOx in combustion effluents and U.S. Pat. No. 4,325,924 issued to Arand, et al. on Apr. 20, 1982 for Urea reduction of NO.sub.x in fuel rich combustion effluents teach methods for reducing NOx in combustion effluents involving introducing urea into the combustion effluent.

SUMMARY

The present invention is directed to a method for NOx reduction in a combustion furnace using aqueous urea and high-velocity secondary air introduced into the combustion space via a plurality of asymmetrical injection devices in the reactor at predetermined spaced apart locations.

Thus, it is one aspect of the present invention to reduce NOx formation by the asymmetric injection of urea solutions at temperatures above 2050 F. with use of high-velocity secondary air for the induction of turbulence in the gas column.

These and other aspects of the present invention will become apparent to those skilled in the art after a reading of the following description of the preferred embodiment when considered with the drawings.

DETAILED DESCRIPTION OF THE INVENTION

Figure 1:
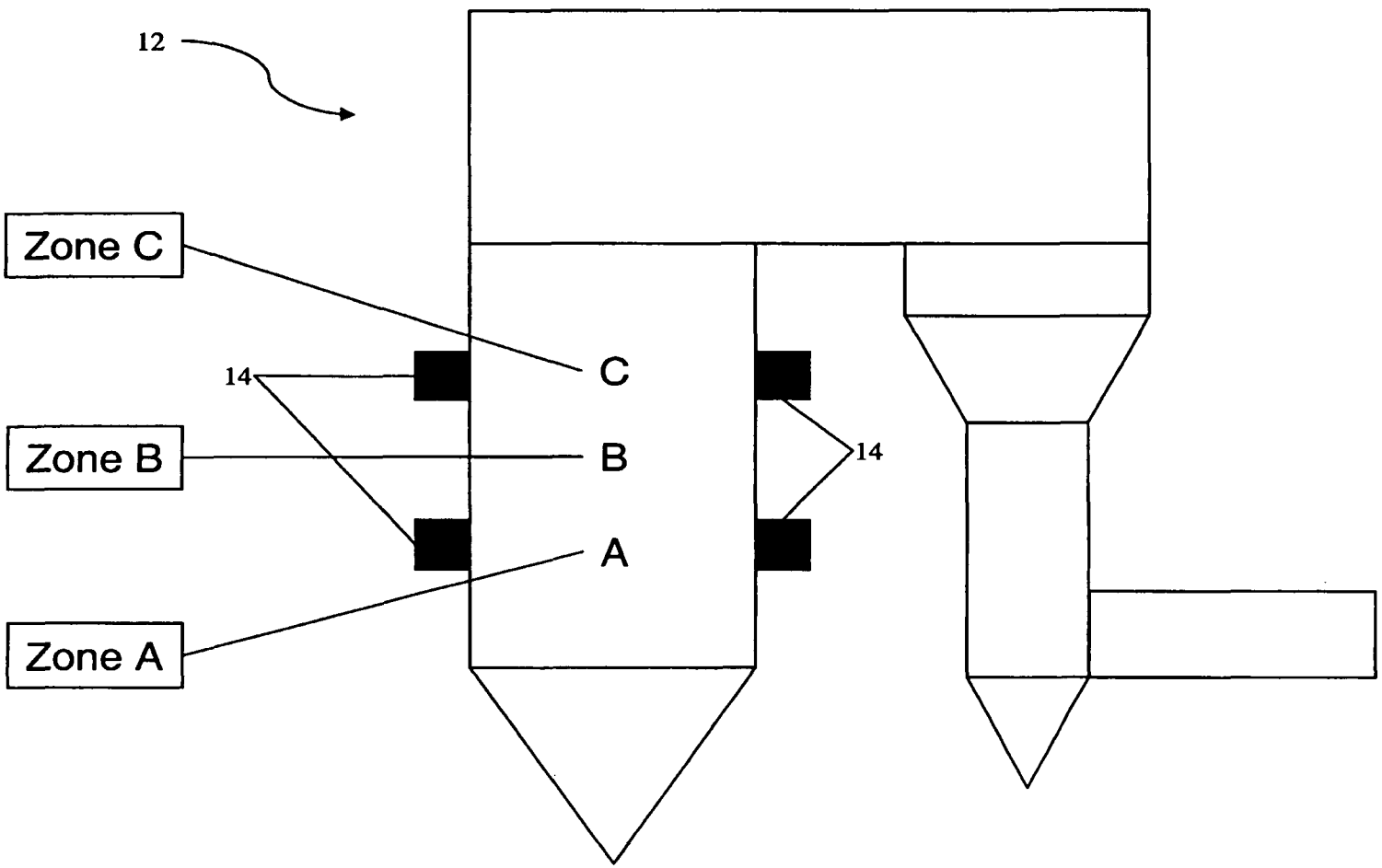
FIG. 1 is a side view of a combustion furnace operated according to the present invention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms. In this description of the embodiment, the term "duct" is used to describe a reagent injection passageway without any constriction on the end. The term "injector" is used to describe a reagent injection passageway with a constrictive orifice on the end. The orifice can be a hole or a nozzle. An injection device is a device that incorporates ducts or injectors or both.

Figure 2:
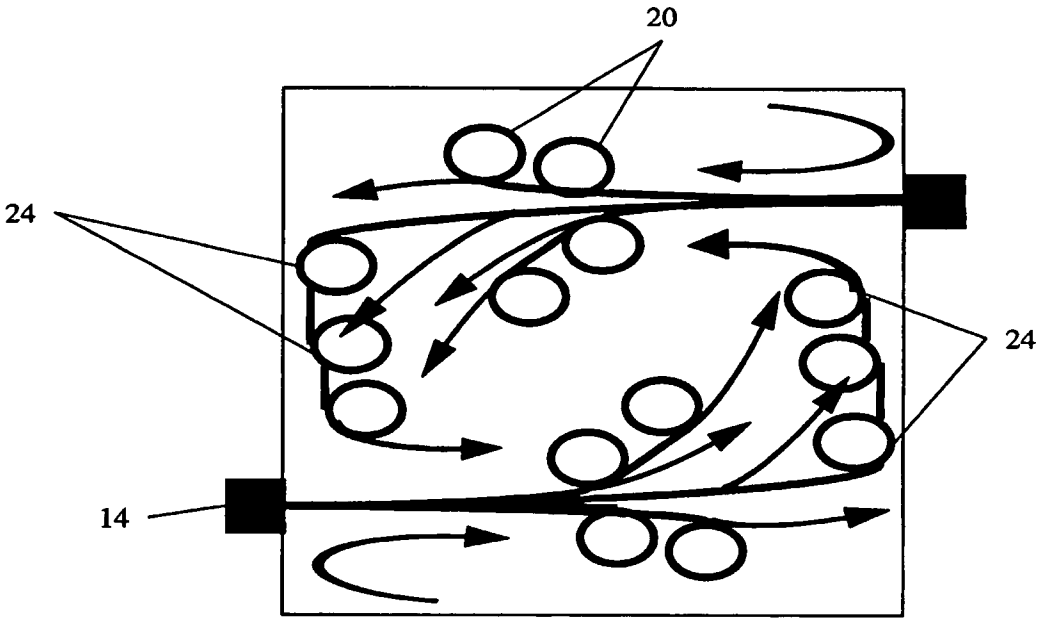
FIG. 2 is a cross-sectional view of Zone A of the furnace of FIG. 1 with opposing injector configuration showing the gas swirl and deflection turbulence induced by operation according to the present invention.
Figure 3:
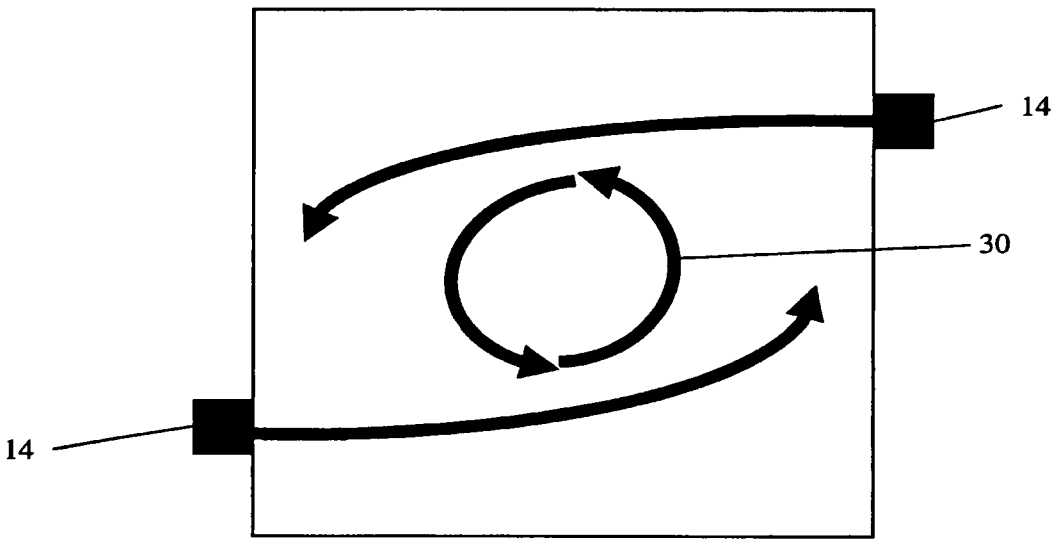
FIG. 3 is a cross-sectional view of Zone A of the furnace of FIG. 1 with opposing injector configuration showing the gas rotation induced by operation according to the present invention.

Referring now to the drawings in general, the illustrations are for the purpose of describing a preferred embodiment of the invention and are not intended to limit the invention thereto. Shown in FIG. 1 is a side view of a combustion furnace, generally described as 12, equipped with an air injection system composed of injection devices 14. As best seen in FIGS. 2 and 3, the present invention provides for an air injection system that creates swirl 20, peripheral turbulence 24, and air column rotation 30 through the tangential injection of secondary air into the furnace. The present invention thus creates turbulence and improves mixing of the overfire air with the combustion gases.

According to the present invention, a system and method are provided for increasing reaction efficiency and for reducing byproducts formation, including the steps of providing a staged reaction system including a reactor and at least one reagent for introduction into a reaction process, preferably one that takes place within the reactor; introducing the at least one reagent, in particular urea, and more particularly solid urea, to the reactor by asymmetrical injection at predetermined, spaced apart locations; controlling the asymmetrical injection to produce a high velocity mass flow and a turbulence resulting in dispersion of the at least one reagent into the reaction system, thereby providing increased reaction efficiency and reduced byproducts formation in the reaction process. Preferably, the at least one reagent is a multiplicity of reagents, more preferably, at least a first reagent and a second reagent wherein the first reagent is introduced prior to the introduction of the second reagent in a first stage and the second reagent is introduced in a second stage, and wherein the stages are spaced apart in location and/or time.

Furthermore, staged additives or reagents are introduced into the reactor system. Preferably, at least one staged additive is introduced via the asymmetrical injection method as set forth herein, wherein the additive is a nitrogenous treatment agent comprising urea, ammonia, ammonium carbamate, ammonium carbonate, mixtures of ammonia and ammonium bicarbonate, one or more of the hydrolysis products of urea or mixtures or complexes thereof, compounds which produce ammonia as a byproduct, ammonium formate, ammonium oxalate, hexamethylenetetramine, ammonium salts of organic acids, 5- or 6-membered heterocyclic hydrocarbons having at least one cyclic nitrogen, hydroxy amino hydrocarbons, amino acids, proteins, monoethanolamine, guanidine, guanidine carbonate, biguanidine, guanylurea sulfate, melamine, dicyandiamide, calcium cyanamide, 1,1'-azobisformamide, methylol urea, methylol urea-urea condensation product, dimethylol urea, methyl urea, dimethyl urea, cyanuric acid (1,3,5-Triazine-2,4,6(1H,3H,5H)-trione; 1,3,5-Triazine-2,4,6-triol; 2,4,6-Trihydroxy- 1,3,5-triazine; Isocyanuricacid; Normalcyanuricacid;Pseudocyanuricacid; sym-triazine-2,4,6-triol; sym-triazinetriol; Triazine-2,4,6 (1H,3H,5H)-trione;Triazine-2,4,6 triol; Triazinetriol; Triazinetrione; Tricarbimide; Tricyanicacid; Trihydroxy-1,3,5-triazine; Trihydroxycyanidine;) biuret (Allophanamide; Carbamylurea; Imidodicarbonic diamide), and the like, and combinations thereof. More preferably, urea and/or urea analogs are used.

Furthermore, the nitrogenous agents listed hereinabove are provided to the system and in the method according to the present invention in at least one phase, namely solid, liquid, molten, and aqueous solution, and combinations thereof. Preferably, the concentration of urea when in solution is diluted and introduced in a predetermined size including droplets, stream, prill, powder, and combinations thereof as appropriate for and corresponding to the phase, and at a predetermined rate or molar ratio.

Other reagents of the system may include reagents to reduce the pH of the combustion effluent, such as alkaline carbonates, such as lime, limestone; hydrated lime; quick lime; soda, trona. Other agents, such as activated charcoal, peroxides, free radicals; NH3; H2O2; and the like, may also be used.

Preferably, according to the present invention, in reactors equipped with catalysts, the reagents or additives are introduced to the reactor system and method between about 0.1 seconds and about 0.2 seconds prior to selective catalytic reduction (SCR) to provide adequate time for mixing prior to contacting the catalyst.

Additionally, the present invention can be used for the reduction of pH of combustion gases through non-reductive acid neutralization. The NH3-generating compounds can be injected after the SCR process to neutralize the acids contained in the gases by acid-base reaction. For example, the $NH_3$ reacts with $SO_3$ to form the salt $(NH_4)_2SO_4$, thereby reducing the levels of sulphuric acid in the combustion gases.

Also, preferably, the reagents or additives are provided at concentrations that produce less than about 2 ppm NH3 slip in the effluent.

In one exemplary embodiment of a reactor system and method according to the present invention, the overfire air is injected into the combustion gases at a velocity and orientation such that the swirl and high turbulence generated in the combustion gases achieve a rapid and thorough mixing of the advected gases and the combustion gases.

In the present embodiment, a nitrogenous agent, such as a Urea and/or NH3 solution, is pumped and directed to a predetermined injector where the pressurized liquid is forced through a nozzle that disperses the liquid into droplets. The nozzle is in the proximity of a ROFA duct, which allows the droplet spray to be carried by the ROFA air into the furnace where it is mixed with the NOx-containing combustion gases. In the case of dry chemical injection, such as lime, solid urea, and the like, the dry chemical is transported with an air stream having a velocity of about 20 m/s to avoid sedimentation of the product. The liquid nozzle is replaced with a dry nozzle and the injected dry chemical is similarly carried and disperse into the furnace by the ROFA jet.

A coaxial injection device may be used to inject the nitrogenous agent in the proximity of the ROFA air. Additionally, other reagents, including cooling liquids and gases, can be injected through the injection device, described as follows.

Figure 6:
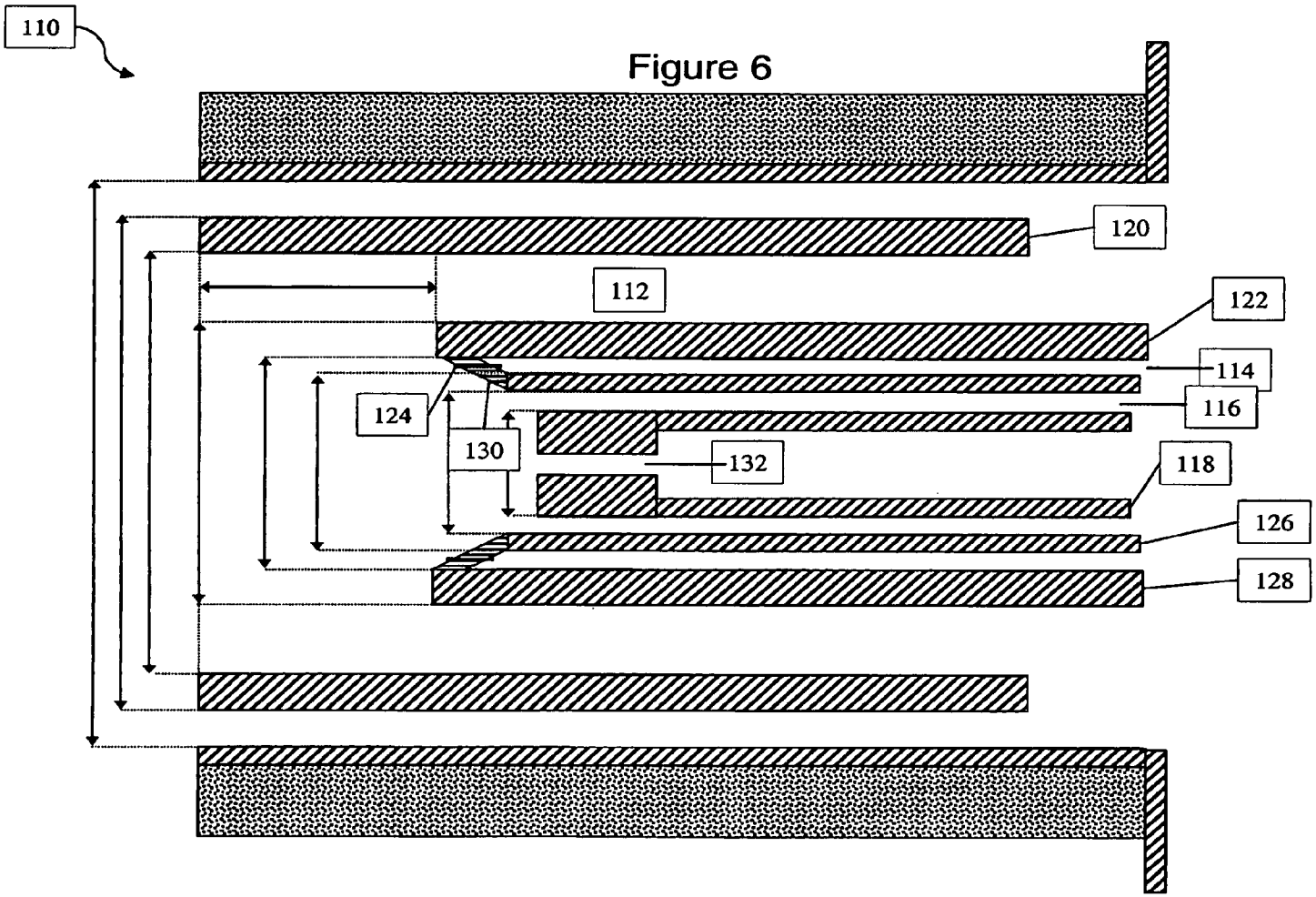
FIG. 6 is a cut-away, side view of a coaxial injection device constructed according to the present invention.

As best seen in FIG. 6, a coaxial injection device according to the present invention, generally described as 110, is composed of an exterior duct 112, an outer-middle injector 114, an inner-middle duct 116, and an interior injector 118.

The exterior duct 112, or high-velocity gas duct, is designed for the injection of high-velocity gas in the reactor. For example, ROFA air can be injected into the reactor through the exterior duct for combustion furnaces. The high-velocity gas mixes and disperses material injected through the other ducts and injectors. For example, cooling water, cooling air, and a nitrogenous agent solution injected into combustion gases for the reduction of NOx are mixed by the ROFA air.

The high-velocity gas disperses solutions without the need for dispersing nozzles; therefore the reactor can use solutions containing particulate. This eliminates or reduces the requirement for pure reagents necessary to prevent obstruction of fine orifices. For example, this device allows the use of low-quality water as cooling water in combustion furnaces, thereby reducing operating expense and improving performance by reducing orifice plugging.

The high-velocity gas duct is formed by the internal wall of the insert 120 and external wall 122 of outer-middle injector 114. The duct is located externally to and circumferentially surrounds all other injectors and ducts, thereby ensuring the dispersion of all reagents injected through the device. The dispersion improves reaction homogeneity, thereby reducing byproduct formation.

Moving inward, the next component of the device is an outer-middle injector 114 with at least one injection orifice 124, such as a hole or nozzle. Preferably, the outer-middle injector has at least 8 nozzles. The outer-middle injector is formed by two concentric cylinders 126 and 128 with a connecting end plate 30 and at least 1 injector orifice 124 in the endplate. This device preferably injects a liquid, for example, cooling water for cooling gases in proximity of injected urea droplets can be injected through this injector. The cooling water reduces free radical oxidation of NH3 to NOx by combustion gases. Alternatively, gases can be injected through this injector. For example, a cooling gas, such as low quality steam that cannot be used for effective power generation, can be injected instead of cooling water into a combustion furnace. Besides the cooling effect, the steam will increase the mass flow and assist the high-velocity gas in carrying and dispersing the other reagents into the furnace.

Moving inward, the next component of the device is an inner-middle duct 116. This duct is formed by the interior cylinder 126 of the outer-middle injector and exterior wall of the interior injector 118. A second gas is preferably injected through this duct. For example, cooling air to keep an injected urea solution cool prior to injection can be injected through this duct. The cooling air prevents urea decomposition prior to injection into the combustion furnace.

The innermost component of the device is an interior injector 118 with constricting orifice 32. The interior injector is preferably formed by a hollow tube with endplate, preferably by a cylinder with endplate. The endplate preferably has a constricting orifice, such as a hole or nozzle. Preferably, liquids are injected into the reactor through this injector. For example, a concentrated nitrogenous agent solution can be injected for the reduction of NOx in a combustion furnace. The SNCR NOx reduction in the combustion gases thereby reduces acid emissions.

The nitrogenous agent can be selected from the group consisting of urea, ammonia, cyanuric acid, ammonium carbamate, ammonium carbonate, mixtures of ammonia and ammonium bicarbonate, one or more of the hydrolysis products of urea or mixtures or complexes thereof, compounds which produce ammonia as a byproduct, ammonium formate, ammonium oxalate, hexamethylenetetramine, ammonium salts of organic acids, 5- or 6-membered heterocyclic hydrocarbons having at least one cyclic nitrogen, hydroxy amino hydrocarbons, amino acids, proteins, monoethanolamine, guanidine, guanidine carbonate, biguanidine, guanylurea sulfate, melamine, dicyandiamide, calcium cyanamide, biuret, 1,1'-azobisformamide, methylol urea, methylol urea-urea condensation product, dimethylol urea, methyl urea, dimethyl urea.

Preferably, the nitrogenous agent is urea. More preferably, the nitrogenous agent is greater than about 20% aqueous urea w/w. Alternatively, more dilute solutions of nitrogenous reagent can be used.

The outer middle injector is preferably recessed in from the edge of the insert to protect the injector orifices from the reaction heat and reactants. The inner injector is recessed within the outer middle inject, to further protect it from the reaction heat and reactants.

A specific example of the reduction of NOx in a combustion furnace using urea with this coaxial device follows:

A combustion furnace operating at approximately 1300 degrees C. was fitted with asymmetrical coaxial ROFA ducts. The pressure of the ROFA air was adjusted to between about 1 and about 20 bar relative to the combustion space to provide sufficient mass flow to ensure adequate turbulence for mixing and heat exchange. A 20% urea solution was injected through the inner injector at a stoichiometric rate of from about 0.1 to about 6.0 NH3/NOx ratio. Great NOx reduction was achieved with a NH3/NOx ratio between about 1 and about 2. Cooling water was injected at about 0.5 to about 40 H2O/NH3 ratio. Greater reduction in NOx was achieved with a H2O/NH3 ratio between about 1 to about 6. The temperature of the cooling air was maintained below 100 degrees C. and the velocity was maintained above about 2 m/s to ensure that the urea solution was not boiling in the inner injector.

Figure 7:
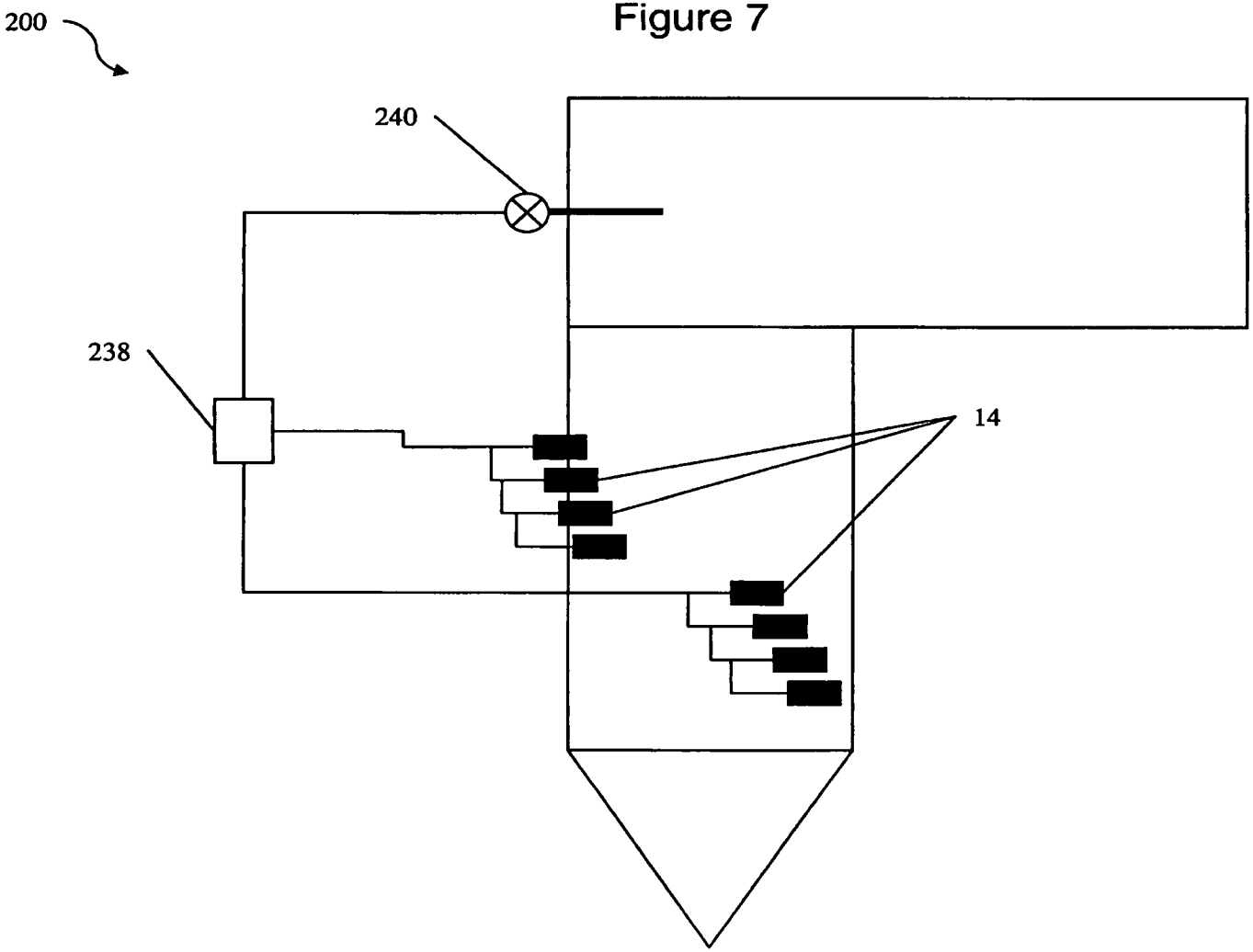
FIG. 7 is a side view of a multiple coaxial device injection system according to the present invention.

As shown in FIG. 7, a multiplicity of injection devices 14 according to the present invention can be combined to form a multiple injection system, generally described as 200. The system includes a system controller 238. The multiple coaxial injection system can be operated to provide higher efficiency reactions and reduced byproducts.

The injection devices 14 are installed at spaced-apart locations along the reactor length. At least 1 probe 240 is installed downstream of at least one of the injectors of the system. Preferably, the probe is installed downstream of the last injector. In an example embodiment, the injectors are positioned along a combustion furnace and the probe is a temperature probe installed at the end of the combustion chamber.

A method of using the multiple injection system in a combustion furnace includes the following steps:

1) measuring reactor temperature;

2) selecting the injection device most suitable for injecting the nitrogenous agent; and 3) injecting the nitrogenous agent through the selected injection devices.

An optional step includes flushing deselected injection devices with a cleaning fluid to prevent fouling.

Figure 4:
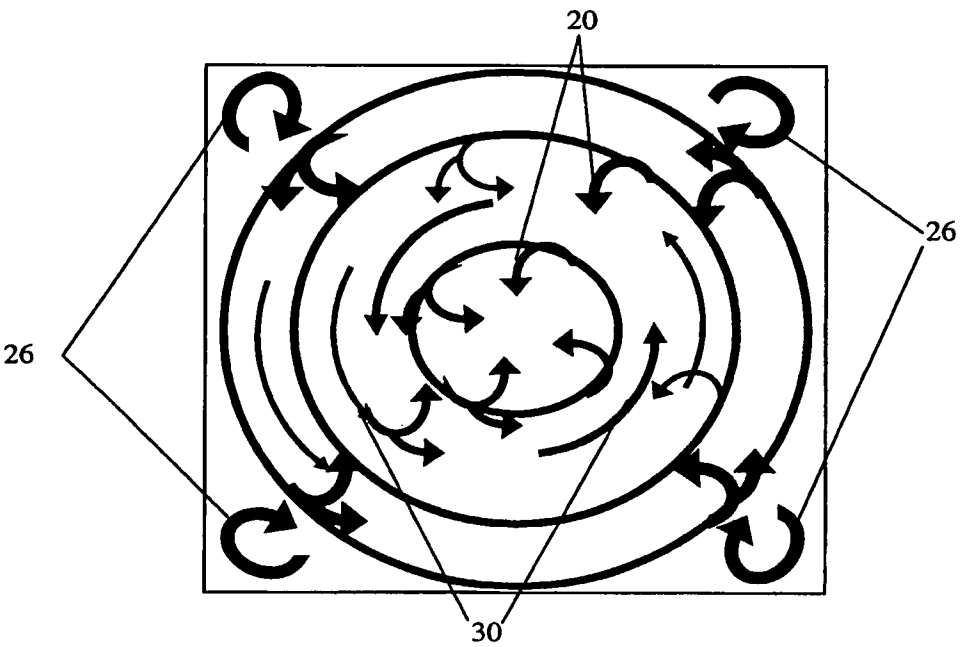
FIG. 4 is a cross-sectional view of Zone B of the furnace showing the turbulence induced by rotation in a non-circular furnace.

As shown in FIG. 2, another embodiment according to the present invention, injection of the overfire air into the combustion gases is effected in such a manner that the advected air travels across the column of combustion gases and is deflected by the opposing wall. This forceful injection induces turbulent mixing of the advected air and combustion gases in at least three ways: 1) by the generation of swirl 20 in the gas column, 2) the generation of turbulence in proximity of the opposing wall after deflection of the advected air by the wall 24, and 3) by the turbulence caused by the rotation of the column of combustion gases in a non-circular furnace, shown as 26 in FIG. 4. Swirl 20 is also generated by the rotation of the gas column, as shown in FIG. 4. The rotation, shown as 30 in FIG. 3, is produced through the tangential injection into the furnace of the advected ROFA air, i.e. there is an injection device on each side of the furnace. The injection device on the right may be, for example, toward the rear of the furnace while the injection device on the left side may be toward the front side of the furnace. This placement of injection devices results in a "swirl" being created in the furnace much like the injection of water in a whirlpool can create a swirl, resulting in mixing, such as described in U.S. Pat. No. 5,809,910 issued Sep. 22, 1998 to Svendssen. This system provides for the asymmetrical injection of overfire air (OFA) in order to create turbulence in the furnace, thus more thoroughly mixing the secondary air and the combustion gases.

Turbulence generated in proximity of the opposing wall is achieved when the advected air strikes the opposing wall before being completely mixed into the combustion gases. That is, the penetration of the injected secondary air is greater than the width of the furnace and the secondary air deflects off the opposing wall and generates turbulent flow. To achieve penetration and, therefore, turbulence, the advected gas must have sufficient linear momentum to penetrate the primary gas, strike the deflecting surface, and rotate. This linear momentum is described as mass flow for a continuous gas stream. The mass flow (m) of a fluid is defined as follows:

m=density of fluid×Area×average fluid velocity normal to Area

The mass flow of the advected gas must be sufficient to traverse the column of flue gas, strike the deflecting surface, and create turbulence. The distance from injection to deflection, represented by the width of the flue gas chamber, dictates the necessary mass flow required to achieve turbulence. However, since the desired rate of added gas mass is limited, it is often desirable to increase the velocity of the advected gas, thereby increasing the mass flow. Thus, greater mass flow of the advected air can be attained by increasing the velocity of the gas.

Rotation of combustion gas column in a furnace with a non-circular cross-section causes additional turbulence formation due to the non-circular cross-section. The rotation is achieved, as previously described, by the use of opposing, coordinated, tangential injection of secondary air into the combustion gas column. Thus, rotation of the gas column in a non-circular cross-section furnace produces rotation-induced turbulence, especially at the furnace/gas interface.

In a system according to the present invention, a staged system and method are provided. In one embodiment, the staged system includes a series of reagent introduction ducts with nozzles advecting the reagents into a moving column of reagents, wherein the ducts are positioned in a predetermined, spaced apart manner to create rotational flow of the combustion zone, as described in U.S. Pat. No. 5,809,910, incorporated herein by reference in its entirety. The reagent injection ducts are preferably arranged to act at mutually separate levels or stages on the mutually opposing walls of the reactor, as shown in FIGS. 1 and 2, which illustrate a furnace of an incineration unit as the reactor and/or are displaced laterally in pairs in relation to one another. Additionally, the ducts may further include nozzles, which are preferably positioned at successively increasing distances along the axis of flow of the furnace away from the furnace, as shown in FIG. 1, such that rotation is maintained by the co-ordinated, reinforcing, tangential injection of high-velocity secondary air into the combustion gas column, generally described as 50 in FIG. 5, which is considered one of the reagents according to the present invention.

A fourth means of producing turbulence in the reactor of the present invention is through the advection of overfire air or gases that are cooler than the combustion gases. This cooler air produces additional turbulence from the thermal expansion it undergoes upon mixing with the combustion gases. That is, the advected gas expands as it is warmed to the combustion gas temperature by the combustion gas, thus displacing and further mixing the surrounding combustion gas. However, in the case of combustion power plants, the advected air should not be so cold as to reduce the temperature of the exiting combustion gases and thus reduce heat exchange efficiency. In these furnaces, ambient air between −20 and 100 degrees centigrade (−4 to 212 degrees F.) can be used in the advected gas. Preheated gas, such as from redirected combustion air, may also be used in the advected gas. The redirected combustion air is preferably between 100 and 500 degrees centigrade (200 and 930 degrees F.) and is preferably mixed, if needed, with the ambient air at between 10 to 50% of the total advected gas, to provide an advection gas with temperature of between about 40 and 460 degrees centigrade. More preferably, the redirected combustion air is mixed at 20-40% of the total advected gas, if needed to provide an advection gas with temperature of between about 76 and 340 degrees centigrade. This gas mixture is therefore warm enough not to reduce the combustion gas temperature significantly and can also readily participate in the combustion reaction upon mixing with the combustion gas.

These turbulences can thus be further augmented by using high-velocity secondary air, which is considered one of the at least one reagents of the present invention. During testing of the system, secondary air was injected into reactors, where, in particular embodiments tested, the reactors were furnaces of various sizes at velocities ranging from 60-300 m/s using booster fans. The velocity necessary to provide sufficient mixing is dependent upon the size of the reactor, the vertical velocity of the combustion gasses and the configuration of the furnace. Surprisingly, the turbulence generated was sufficient that the entire furnace began operating as a single burner. The increased turbulence, mixing swirl, and rotation in the furnace resulted in improved combustion, increased efficiency of the fuel combustion, reduction in secondary air requirements with consequential increased retention time of the combustion gases in the furnace, lower furnace exit gas temperatures due to better heat exchange in the furnace, increased boiler efficiency and lower pollutant emissions.

From the tests it was determined that the ratio of the advected air velocity to the reactor, or in a particular embodiment a furnace, width (v/w) needs to be between about 2 to about 150 $sec^{-1}$, preferably between about 3 and 60 $sec^{-1}$.

Furthermore, it was determined that the velocity of the advected air should result in the combustion gas column rotating at least one half-turn prior to exiting the furnace, more preferably at least 1 turn prior to exiting the furnace. To achieve this rotation, at least two levels of injection of at least one reagent are required, thereby providing for at least two stages of the system and method according to the present invention. More preferably at least three levels of injection are used for providing increased efficiency and for reduction of byproducts.

Alternatively, the velocity of the injected air needs to be such that the penetration of the injected reagent(s), which may include air, and which preferably include urea and/or a urea analog as set forth in the foregoing, is greater than the reactor width by at least about 1.5 reactor widths, more preferably by at least 2 reactor widths.

The reduction in the secondary air results in a decrease in combustion gas volume, which results in an increased residence time of the combustion gases in the furnace and thus more time for thermal flux to occur into the furnace water/steam conduits for a furnace example of a reactor system and method according to the present invention.

Additionally, the rotation of reagents in a non-circular cross-section reactor generates turbulence at the reagent/reactor surface interface. This turbulence reduces the laminar flow of the combustion gases at the interface and therefore improves the heat transfer across the interface. The turbulence generated by the rotation also further mixes the combustion gases and reduces laminar or parallel flow up the reactor. Combustion reactions in prior art non-circular reactors tend to demonstrate sidedness, that is the reactions are on a particular side or zone of the furnace versus other sides, resulting in non-uniform combustion within the reactor. Thus, the present invention advantageously utilizes the non-circular nature of the reactor's cross-section to eliminate the sidedness of the reactor. The rotation that overcomes this sidedness is achieved by the co-ordinated, reinforcing, tangential, or asymmetrical, injection of high-velocity secondary air as a reagent into the combustion column of the reactor.

Similarly, the vigorous mixing in the combustion area produced by the present invention also prevents the laminar flow and consequential lower residence time of higher inertia particles in the reactor, such as combustible particulate, thereby allowing them more time to burn in the reactor and further increasing the combustion efficiency and thermal flux efficiency of the reactor, as well as reducing the formation of byproducts, in particular pollutants such as NOx.

Thus, the present invention utilizes the co-ordinated, reinforcing, tangential injection of high-velocity secondary air to improve the combustion efficiency and thermal flux efficiency of reactors of various cross-sectional shapes.

A method according to the present invention for increasing reactor efficiency and reduced NOx production includes providing a reactor with a plurality of reagent introduction or injection ducts, asymmetrically positioned in an opposing manner at spaced apart, predetermined locations; injecting fuel with primary air through the burners prior to the injection of secondary air; injecting secondary air reagent with a nitrogenous agent through the plurality of reagent introduction or injection ducts, controlling the asymmetrical injection to produce a high velocity mass flow and a turbulence resulting in dispersion of the at least one reagent into the reaction system, wherein one of the at least one reagents is an NH3-producing compound;

thereby providing increased reaction efficiency and reduced NOx formation in the reaction process.

The injection velocity may be controlled to achieve the desired mass flow. The injection velocity is controlled such that the ratio of the velocity to the reactor width is between about 2 $sec^{-1}$ to about 150 $sec^{-1}$, preferably between about 3 and about 60 $sec^{-1}$; thereby increasing combustion efficiency and reactor efficiency via mixing and rotation of the reactor space, and improving the reduction of byproducts such as pollutants.

Alternatively or additionally, the velocity of the injected air as a reagent is such that the penetration of the injected air reagent is greater than the reactor width by at least about 1.5 widths and/or the reagents acting within a reaction zone, which may include combustion activity, rotates at least one half revolution prior to exiting the reactor.

Figure 5:
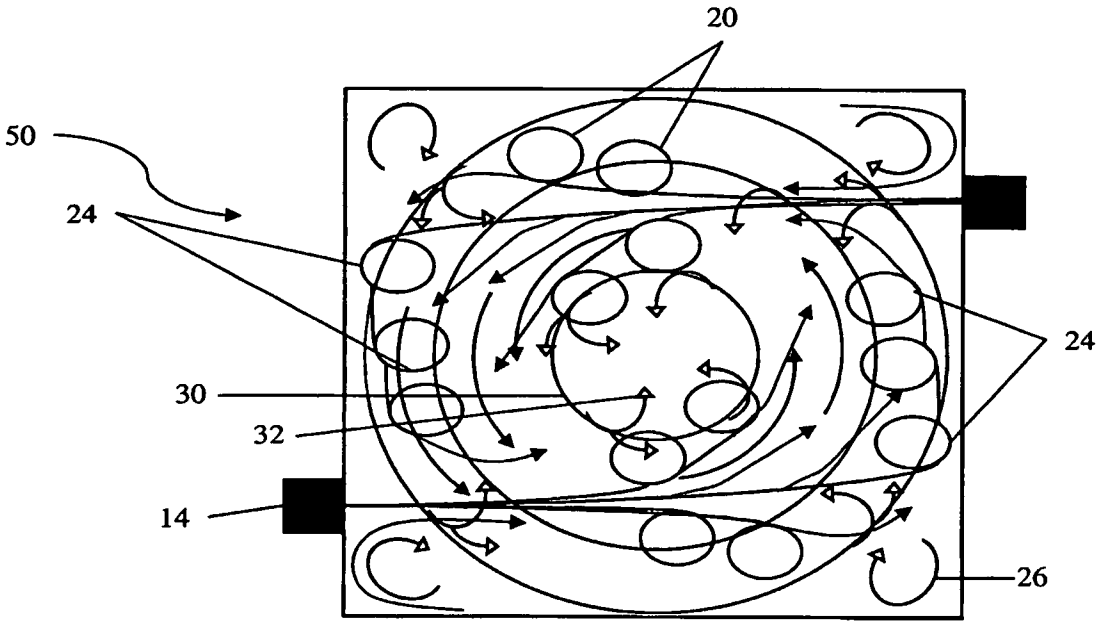
FIG. 5 is a cross-sectional view of Zone C of the furnace with opposing injector configuration showing the swirl, deflection, and rotation-induced turbulence induced by operation according to the present invention.
Figure 8:
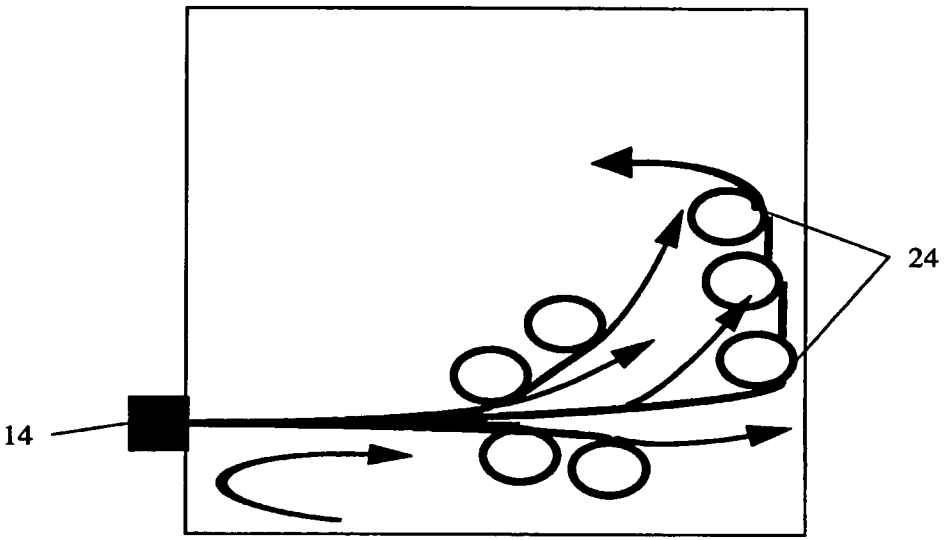
FIG. 8 shows a cross-sectional view of a furnace with unilateral injector configuration.
Figure 9:
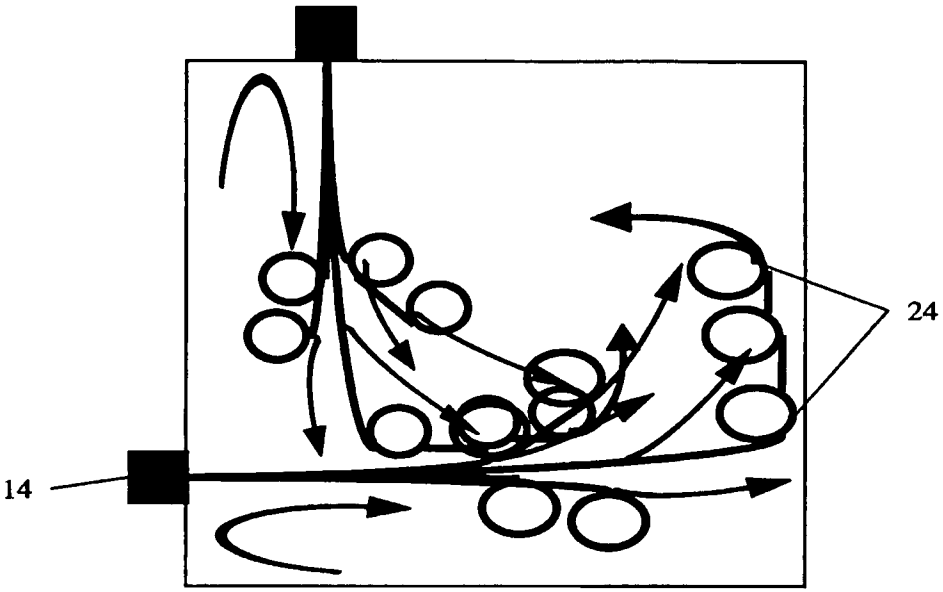
FIG. 9 shows a cross-sectional view of a furnace with crosscurrent injector configuration.

A variety of injection device configurations can be used to achieve a co-ordinated, re-inforcing injection resulting in high turbulence as previously described. In addition to the asymmetrically opposing injector configurations, as shown in FIGS. 2, 3, and 5, alternative injector configurations include unilateral injector configurations, as shown in FIG. 8, and cross-current injector configurations, as shown in FIG. 9. In the unilateral configurations, the injectors are located on only one side of the reactor. In the cross-current injector configurations, the injectors are directed such that at least one injector directs injected reagent across the path of reagent injected by at least one other injector.

These alternative configurations are used when appropriate, such as in cases where an opposing side is inaccessible, unilateral or cross-current injector configurations may be used. For example, in combustion furnaces requiring the injection of ammonia or urea after the furnace section of the boiler into the convection pass and back pass of the boiler, in these places opposing sides are generally not accesssible and therefore the chemicals are injected on one side only or on adjacent sides instead of from opposing sides.

Additionally, multiple injectors located on a side of a reactor can be arrranged to give co-ordinated re-inforcing rotation. For example, the injectors can be located in about the same plane, such that the injected reagents travel in approximately parallel paths.

The present invention thus permits a combustion furnace with NH3-based NOx-reduction system to be operated with certain parameters outside of prior art operating parameters. The present invention permits the use of aqueous urea solutions that are high concentration and/or fine sprays to be injected into the furnace at high temperature locations. For example, prior art demonstrates that to achieve NOx reduction by injection of urea solutions at temperatures above 2050 F., urea concentration should be less than 20%, preferably 0.5-7% and droplet size should be 150-10,000 um Sauter mean diameter. The present invention permits the system to be operated at the higher temperatures while injecting the urea as a concentrated solution with large droplet sizes or as a dilute urea solution with small droplet sizes. The high turbulence quickly disperses the urea solution into the combustion gases and continues to mix the gases and the urea, thereby favoring the probability that a $NH_3$ moiety generated from the urea will encounter a NOx moiety before the NH3 moiety is oxidized to NOx by the combustion gases. Additionally, the high turbulence reduces the spaces of excessive heat in the combustion gases that can cause the NH3 moieties to quickly oxidize. Thus, the present invention reduces the potential for oxidation of NH3 moieties to NOx and permits the introduction of NH3-releasing compounds at temperatures higher than acceptable as taught by the prior art.

Thus, a method for reducing NOx formation according to the present invention includes the steps of: providing a staged combustion system including a furnace with a plurality of asymmetrical injection devices for introducing at least one reagent to the reactor by asymmetrical injection at predetermined, spaced apart locations; injecting fuel with primary air through a first stage prior to injection of a second air; injecting secondary air and aqueous urea solution through the plurality of injection devices; wherein the aqueous urea solution has a urea concentration greater than about 20% w/w and is injected at furnace locations with temperatures above about 2050 F.; and controlling the asymmetrical injection of secondary air to produce a turbulence resulting in dispersion of the urea solution into the reaction system; thereby providing reduced NOx formation in the reaction process.

In another method according to the present invention, the urea solution is preferably sprayed as a fine mist and/or the urea solution concentration is greater than about 10% w/w and/or the combustion space temperature is preferably above about 2000 F.

Additionally, humidification of the combustion space in the microenvironment of the aqueous urea droplets further increases the upper temperature limit at which aqueous urea solutions that are very high concentration and/or very fine sprays can be injected into the furnace. For example, prior art demonstrates that to achieve NOx reduction by injection of urea solutions at temperatures above 2050 F., urea concentration should be less than 20%, preferably 0.5-7% and droplet size should be 150-10,000 um Sauter mean diameter. The present invention with humidification permits the system to be operated while injecting the urea as a concentrated solution with large droplet sizes or as a dilute urea solution with small droplet sizes at an even higher temperatures than with the ROFA alone while.

The present invention controls the relative humidity and temperature of droplet environment such that an injected droplet does not evaporate prior to reaching the proper temperature. The present invention preferably increases the relative humidity and reduces the temperature of the combustion space proximal or prior to droplet injection in a manner that the droplets will be injected into a humidified and cooled environment. Alternatively or additionally, the relative humidity can be increased after the droplets are injected, sufficiently in time that the droplets do not evaporate completely prior to reaching the desired temperature and/or location.

The present invention also reduces the temperature of the droplet environment through the injection of the water. The water evaporates upon injection. This evaporation reduces the temperature of the droplet environment, which means that the inject reagent is exposed to cooler gases, even as those gases mix with hot combustion gases in the furnace.

The cooling of the droplet environment along with the simultaneous increase in the relative humidity of the droplet environment work together to ensure that the reagent reaches the appropriate temperature zone in the combustion furnace without prematurely reacting.

For a combustion furnace, a method for increasing the droplet half-life of water reagent droplets in a droplet environment having a droplet environment temperature within a combustion furnace having a combustion space, the water droplets comprising water and at least one reagent solute, the method steps include: increasing the relative humidity of the droplets environment in the furnace through the injection of a humidifying agent; adjusting the injection location and injection rate of the humidifying agent to improve effectiveness of the reagent solute by increasing the efficiency of a reaction of the reagent within the furnace; thereby reducing the evaporation rate of the droplet and increasing the half-life of the droplets in the combustion furnace.

A method for reducing NOx in a combustion furnace includes the steps of: injecting water into the combustion space; injecting high-velocity air in the path of the injected water to disperse and evaporate the water; thereby humidifying and cooling a space in the combustion furnace to form a humidified space; injecting a NOx-reducing agent dissolved in water into the humidified space in the combustion furnace in a manner to form droplets, the droplets having an droplet environment and the droplet environment having a droplet environment temperature; wherein the humidification and cooling of the droplet environment extends the droplet half-life in the combustion furnace to permit the reagent to reach the desired reaction location in the furnace; thereby reducing the NOx emissions of the combustion furnace.

Certain modifications and improvements will occur to those skilled in the art upon a reading of the foregoing description. All modifications and improvements have been deleted herein for the sake of conciseness and readability but are properly within the scope of the following claims.

What is claimed is:

1. A method for reducing NOx formation, comprising the steps of:

providing a staged combustion system including a furnace with a plurality of asymmetrical injection devices for introducing at least one reagent to the reactor by asymmetrical injection at predetermined, spaced apart locations;

injecting fuel with primary air through a first stage prior to injection of a second air;

injecting secondary air and aqueous urea solution within the reactor at temperatures above about 2000° F. through the plurality of injection devices; wherein the aqueous urea solution has a urea concentration greater than about 20% w/w and is injected at furnace locations with temperatures above about 2000° F., and wherein injection at the temperature range may be achieved without special chemicals; and creating turbulence within the reactor by controlling the asymmetrical injection of secondary air to produce the turbulence resulting in dispersion of the urea solution into the reaction system at temperatures above about 2000° F., thereby increasing the residence time of the combustion gases in the furnace and providing reduced NOx formation in the reaction process during a staged combustion system, wherein the velocity of the secondary air is such that the ratio of the velocity to the reactor width is between about 2 $sec^{-1}$ to about 150 $sec^{-1}$; thereby increasing reagent dispersion via swirl, peripheral turbulence, and rotation-induced turbulence of the reactor.

2. The method according to claim 1, wherein the urea solution is sprayed as a fine mist.

3. The method according to claim 1, wherein the urea solution concentration is greater than about 20% w/w.

4. The method according to claim 1, wherein the temperature is above about 2050° F.

5. The method according to claim 2, wherein the temperature is above about 2050° F. and the urea solution is greater than about 20% w/w.

6. The method according to claim 1, wherein the reactor space is humidified.

7. The method of claim 6, further including the step of increasing the relative humidity in the droplet environment by injecting water into the droplet environment at a predetermined location and at a predetermined rate such that the injected solvent disperses and evaporates in the reactor.

8. The method according to claim 1, further including the step of adding additional said fluids in stages, spaced apart in location and time.

9. The method according to claim 1, wherein the secondary air and urea solution are introduced at a plurality of injection devices, asymmetrically positioned in an opposing manner.

10. The method of claim 1, wherein the injection step includes injecting at least two levels of injection devices.

11. The method of claim 10, wherein the injection step includes injecting at least three levels of injection devices.

12. A method for reducing NOx formation, comprising the steps of:

providing a staged combustion system including a furnace with a plurality of asymmetrical injection devices for introducing at least one reagent to the reactor by asymmetrical injection at predetermined, spaced apart locations;

injecting fuel with primary air through a first stage prior to injection of a second air;

injecting secondary air and aqueous urea solution within the reactor at temperatures above about 2000° F. through the plurality of injection devices; wherein the aqueous urea solution has a urea concentration greater than about 20% w/w and is injected at furnace locations with temperatures above about 2000° F. and wherein injection at the temperature range may be achieved without special chemicals, and the velocity of the injected secondary air is such that the penetration of the injected fluids is greater than the reactor width by at least about 1.5 widths; and creating turbulence within the reactor by controlling the asymmetrical injection of secondary air to produce the turbulence resulting in dispersion of the urea solution into the reaction system at temperatures above about 2000° F., thereby increasing the residence time of the combustion gases in the furnace and providing reduced NOx formation in the reaction process during a staged combustion system, and wherein the velocity of the secondary air is such that the ratio of the velocity to the reactor width is between about 2 $sec^{-1}$ to about 150 $sec^{-1}$; thereby increasing reagent dispersion via swirl, peripheral turbulence, and rotation-induced turbulence of the reactor.

13. The method according to claim 12, wherein the urea solution is sprayed as a fine mist.

14. The method according to claim 12, wherein the urea solution concentration is greater than about 20% w/w.

15. The method according to claim 12, wherein the temperature is above about 2050° F.

16. The method according to claim 13, wherein the temperature is above about 2050° F. and the urea solution is greater than about 20% w/w.

17. The method according to claim 12, wherein the reactor space is humidified.

18. The method of claim 17, further including the step of increasing the relative humidity in the droplet environment by injecting water into the droplet environment at a predetermined location and at a predetermined rate such that the injected solvent disperses and evaporates in the reactor.

19. The method according to claim 12, further including the step of adding additional said fluids in stages, spaced apart in location and time.

20. The method according to claim 12, wherein the secondary air and urea solution are introduced at a plurality of injection devices, asymmetrically positioned in an opposing manner.

21. The method of claim 12, wherein the injection step includes injecting at least two levels of injection devices.

22. The method of claim 21, wherein the injection step includes injecting at least three levels of injection devices.

23. A method for increasing combustion furnace efficiency and reducing NOx, comprising:

providing a reactor with a plurality of reagent injection devices, asymmetrically positioned in an opposing manner; and injecting NOx-reducing fluids comprising at least one nitrogenous agent through the devices in the proximity of high-velocity secondary air in stages during a staged combustion system within the reactor at temperatures above about 2000° F., wherein one of the at least one agents is urea at a concentration greater than about 20% w/w and the temperature is above about 2000° F., wherein injection at the temperature range may be achieved without special chemicals, and wherein the velocity of the secondary air is such that the at least one injected reagent is dispersed and the combustion gas column rotates at least one half revolution prior to exiting the reactor; thereby reducing NOx via mixing and rotation of the reagents and gases in the reactor, and wherein the velocity of the secondary air is such that the ratio of the velocity to the reactor width is between about 2 $sec^{-1}$ to about 150 $sec^{-1}$; thereby increasing reagent dispersion via swirl, peripheral turbulence, and rotation-induced turbulence of the reactor.

24. The method according to claim 23, wherein the urea solution is sprayed as a fine mist.

25. The method according to claim 23, wherein the temperature is above about 2050° F.

26. The method according to claim 23, wherein the urea solution is greater than about 20% w/w.

27. The method according to claim 23, wherein the reactor space is humidified.

28. The method of claim 27, further including the step of increasing the relative humidity in the droplet environment by injecting water into the droplet environment at a predetermined location and at a predetermined rate such that the injected solvent disperses and evaporates in the reactor.

29. The method according to claim 23, further including the step of adding additional said NOx-reducing fluids in stages, spaced apart in location and time.

30. The method according to claim 23, wherein the secondary air and urea solution are introduced at a plurality of injection devices, asymmetrically positioned in an opposing manner.

31. The method according to claim 23, wherein the injection step includes injecting at least two levels of injection devices.

32. The method according to claim 31, wherein the injection step includes injecting at least three levels of injection devices.

* * * * *